US005721805A

United States Patent [19]

Cook et al.

[11] Patent Number: 5,721,805

[45] Date of Patent: Feb. 24, 1998

[54] HIGH ENERGY SOURCE MODULE WITH DIAGONAL LAMPS

[75] Inventors: Edward R. Cook; Jonathan S. Petty; Joseph R. Adamski, all of Cedar Rapids, Iowa

[73] Assignee: Amana Refrigeration Inc., Amana, Iowa

[21] Appl. No.: 631,716

[22] Filed: Apr. 10, 1996

[51] Int. Cl.[6] ..... F26B 3/30

[52] U.S. Cl. ..... 392/411; 392/414; 392/420; 392/422; 219/405; 250/504 R; 34/266; 34/270; 362/281

[58] Field of Search ..... 392/416–424, 392/426–429, 411–415; 219/404, 411; 250/504 R, 495.1; 34/266, 270, 273; 362/281–284, 319

[56] References Cited

U.S. PATENT DOCUMENTS

| | | | |
|---|---|---|---|
| 2,315,124 | 3/1943 | Luzius | 34/266 |
| 3,689,735 | 9/1972 | McLeod et al. | 392/420 |
| 3,836,751 | 9/1974 | Anderson | 219/411 |
| 4,179,600 | 12/1979 | Haberhauer | 392/422 |
| 4,200,903 | 4/1980 | Koenig et al. | 362/134 |
| 4,546,261 | 10/1985 | Gonser et al. | 250/504 R |
| 4,960,977 | 10/1990 | Alden | 219/411 |
| 5,418,885 | 5/1995 | Hauser et al. | 392/416 |
| 5,515,605 | 5/1996 | Hartmann et al. | 392/419 |

FOREIGN PATENT DOCUMENTS

| | | | |
|---|---|---|---|
| 266674 | 4/1989 | Germany | 302/420 |
| 3731321 | 4/1989 | Germany | 250/504 R |
| 545148 | 5/1957 | Italy | 392/423 |
| 2-272255 | 1/1990 | Japan . | |

*Primary Examiner*—Tu B. Hoang
*Attorney, Agent, or Firm*—Sarah L. Byrne; Glenn H. Lenzen

[57] ABSTRACT

A module for use in a heating appliance has a frame with first, second, third, and fourth sides. A first heating lamp is mounted substantially along the first side of the frame, a second heating lamp is mounted substantially along the second side of the frame, a third heating lamp mounted substantially along the third side of the frame, and an fourth heating lamp is mounted substantially along the fourth side of the frame. Fifth, sixth, seventh, and eighth heating lamps are mounted substantially diagonally to the frame. A first reflector reflects radiant energy from the first heating lamp, a second reflector reflects radiant energy from the second heating lamp, a third reflector reflects radiant energy from the third heating lamp, and a fourth reflector reflects radiant energy from the fourth heating lamp. A fifth reflector reflects radiant energy from the fifth, sixth, seventh, and eighth heating lamps. The first, second, third, and fourth reflectors are generally parabolic reflectors, and the fifth reflector is a formed reflector.

30 Claims, 18 Drawing Sheets

HIGH ENERGY SOURCE MODULE WITH DIAGONAL LAMPS

TECHNICAL FIELD OF THE INVENTION

The present invention is directed to a high energy source module having a source of radiant energy and a reflector, wherein the reflector is arranged to reflect radiant energy emitted by the source.

BACKGROUND OF THE INVENTION

Ovens and other heating appliances which use halogen lamps as the source of radiant energy for heating objects are known. Such ovens typically include a plurality of halogen lamps which are arranged in parallel and adjacent to the ceiling and/or floor of the oven. When the lamps are energized, they emit high power density radiant energy. The heating of objects, such as food, within these ovens results predominantly from this high power density radiant energy radiated by the lamps.

It is also known that better heating results are obtained if the object to be heated within an oven receives a more uniform distribution of radiated energy. One attempt to expose the object to a more uniform distribution of the radiated energy is to use a turntable within the oven in order to turn the object to be heated during the heating cycle. However, the use of a turntable is generally unacceptable because of the additional parts which will ultimately fail and require servicing and/or replacement.

It is also known to use parabolic reflectors within a heating appliance for more uniform distribution of the radiated energy emitted by the heating elements. Thus, when a heating element is placed at the focal point of a parabolic reflector, the energy, which is radiated by the heating element and which impinges on the parabolic reflectors, is generally reflected as parallel energy through the heating space containing the object to be heated. The energy, which is radiated by the heating element and which does not impinge on the parabolic reflectors, is generally radiated spherically.

In present ovens which employ parabolic reflectors, the radiant energy which is emitted by the heating lamps is distributed unevenly across the heating surface. Part of this uneven energy distribution results because the parabolic reflectors either join at edges which do not reflect any of the radiated energy or are spaced apart. Therefore, burn bands are produced because some strips across the heating surface receive both more intense parallel reflected energy and less intense spherically radiated energy while other strips across the heating surface receive only less intense spherically radiated energy. Moreover, the perimeter of the heating surface may receive only less intense spherically radiated energy.

To a certain extent, this uneven distribution of energy may be somewhat ameliorated by using a turntable or by de-focusing the energy sources with respect to the reflectors. However, using a turntable causes the problems discussed above, and de-focusing the energy sources with respect to the reflectors can exacerbate the unevenness of the radiated energy distribution.

Moreover, current ovens employing lamps do not have the flexibility to provide both generally perpendicular radiant energy and non-perpendicular radiant energy with respect to a cooking plane for improving cooking of certain thick foods such as steaks, roasts, chicken, and the like.

The present invention is intended to solve one or more of the above-noted problems.

SUMMARY OF THE INVENTION

According to a first aspect of the present invention, a heating appliance comprises a generally hexahedral enclosure and a plurality of high energy lamps arranged to emit radiant energy to an object to be heated. At least one of the high energy lamps is mounted substantially parallel to a side of the generally hexahedral enclosure, and at least another of the high energy lamps is mounted substantially diagonally with respect to the generally hexahedral enclosure.

According to another aspect of the present invention, an oven comprises an oven housing having sides, and first and second radiant energy emitting means for emitting radiant energy. The first radiant energy emitting means is mounted to the oven housing, and the first radiant energy emitting means is substantially parallel to one of the sides of the oven housing. The second radiant energy emitting means is mounted to the oven housing, and the second radiant energy emitting means is substantially diagonal with respect the sides of the oven housing.

According to yet another aspect of the present invention, a heating arrangement for an oven comprises a source support and first, second, third, fourth, fifth, sixth, and seventh heating lamps. The source support has first, second, third, and fourth sides. The first heating lamp is mounted substantially along the first side of the source support. The second heating lamp is mounted substantially along the second side of the source support. The third heating lamp is mounted substantially along the third side of the source support. The fourth heating lamp is mounted substantially along the fourth side of the source support. The fifth, sixth, and seventh heating lamps are mounted substantially diagonally with respect to the first, second, third, and fourth sides of the source support.

According to still another aspect of the present invention, a source is arranged to emit radiant energy to an object to be heated within a cooking appliance having a cooking plane. The source comprises first and second radiant energy emitting means and first and second reflecting means. The first and second radiant energy emitting means emit radiant energy, and the first and second radiant energy emitting means are generally above the cooking plane. The first reflecting means reflects radiant energy from the first radiant energy emitting means toward a center of the cooking plane. The second reflecting means reflects radiant energy from the second radiant energy emitting means generally perpendicularly over the cooking plane.

BRIEF DESCRIPTION OF THE DRAWINGS

These and other features and advantages of the present invention will become more apparent from a detailed consideration of the invention when taken in conjunction with the drawings in which.

DETAILED DESCRIPTION

Figure 1:
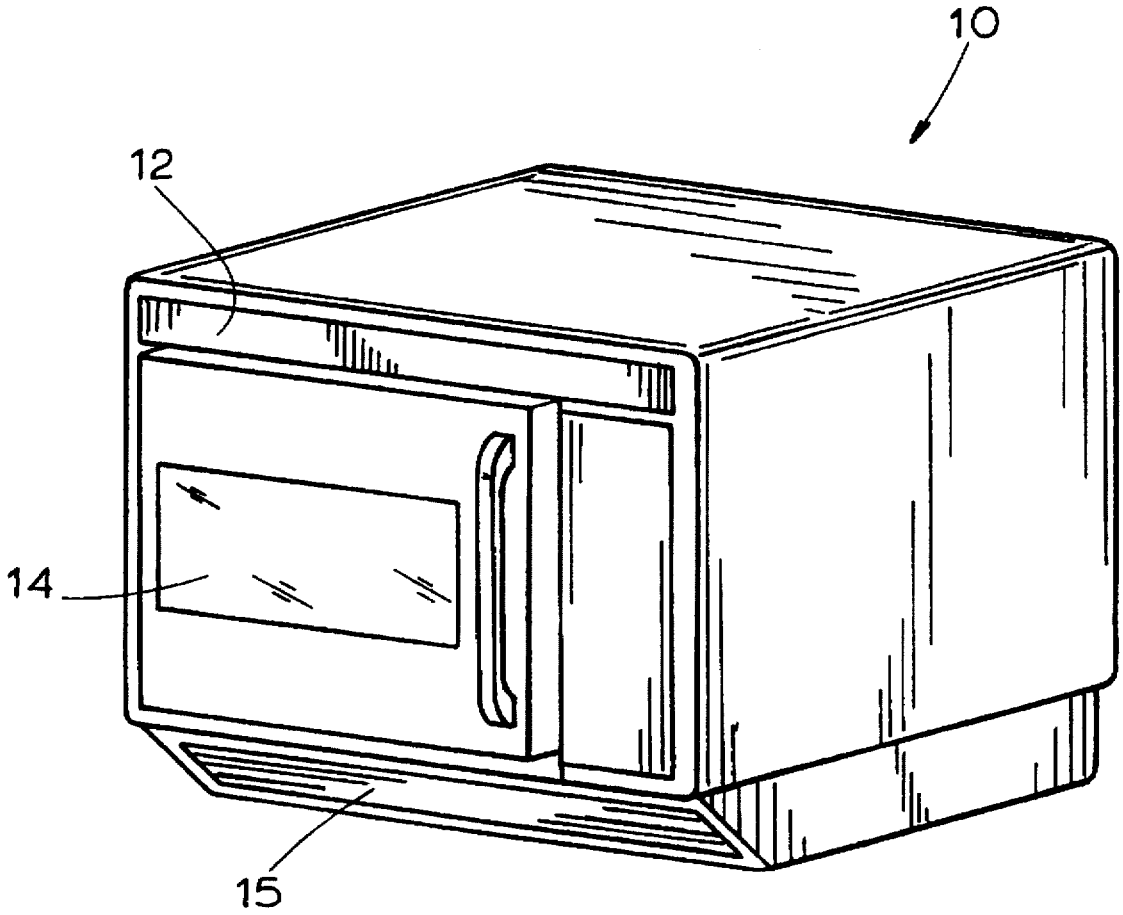
FIG. 1 is an isometric view of a heating appliance utilizing the present invention.

A heating appliance 10 is illustrated in FIG. 1 and includes a high energy source module 12 and a door 14. The door 14 provides access to a heating space within the heating appliance 10. For example, the heating appliance 10 may be an oven for cooking food. The high energy source module 12 is illustrated in more detail in FIGS. 2–6. The heating appliance 10 may also have an air intake 15 at its front and an exhaust (not shown) at its rear thereof.

The high energy source module 12 includes a group of side oriented halogen lamps 16 which includes a first halogen lamp 18, a second halogen lamp 20, a third halogen lamp 22, and a fourth halogen lamp 24. The high energy source module 12 also includes a group of diagonally oriented halogen lamps 26 including a fifth halogen lamp 28, a sixth halogen lamp 30, a seventh halogen lamp 32, and an eighth halogen lamp 34. The high energy source module 12 further includes a quadrilateral module frame 36 which includes a first side 38, a second side 40, a third side 42, and a fourth side 44.

The first side 38, the second side 40, the third side 42, and the fourth side 44 are held in a rigid quadrilateral by a first corner mount 46 which stiffens the corner between the first side 38 and the fourth side 44, a second corner mount 48 which stiffens the corner between the first side 38 and the second side 42, a third corner mount 50 which stiffens the corner formed by the second side 40 and the third side 42, and a fourth corner mount 52 which stiffens the corner formed by the third side 42 and the fourth side 44.

A first corner brace 54 and a second corner brace 56 are also provided to supply additional stiffening of the quadrilateral module frame 36. Accordingly, the first corner brace 54 is suitably attached to the second side 40 and the third side 42 of the quadrilateral module frame 36, and the second corner brace 56 is suitably attached to the first side 38 and the fourth side 44 of the quadrilateral module frame 36.

An electrical lamp connector 58 is attached to the second corner mount 48, and an electrical lamp connector 60 is attached to the first corner mount 46. The electrical lamp connectors 58 and 60 receive the first halogen lamp 18 and provide an electrical connection therefor.

An electrical lamp connector 62 is attached to the second corner mount 48, and an electrical lamp connector 64 is attached to the third corner mount 50. The electrical lamp connectors 62 and 64 receive the second halogen lamp 20 and provide an electrical connection therefor.

An electrical lamp connector 66 is attached to the third corner mount 50, and an electrical lamp connector 68 is attached to the fourth corner mount 52. The electrical lamp connectors 66 and 68 receive the third halogen lamp 22 and provide an electrical connection therefor.

An electrical lamp connector 70 is attached to the fourth corner mount 52, and an electrical lamp connector 72 is attached to the first corner mount 46. The electrical lamp connectors 70 and 72 receive the fourth halogen lamp 24 and provide an electrical connection therefor.

Figure 2:
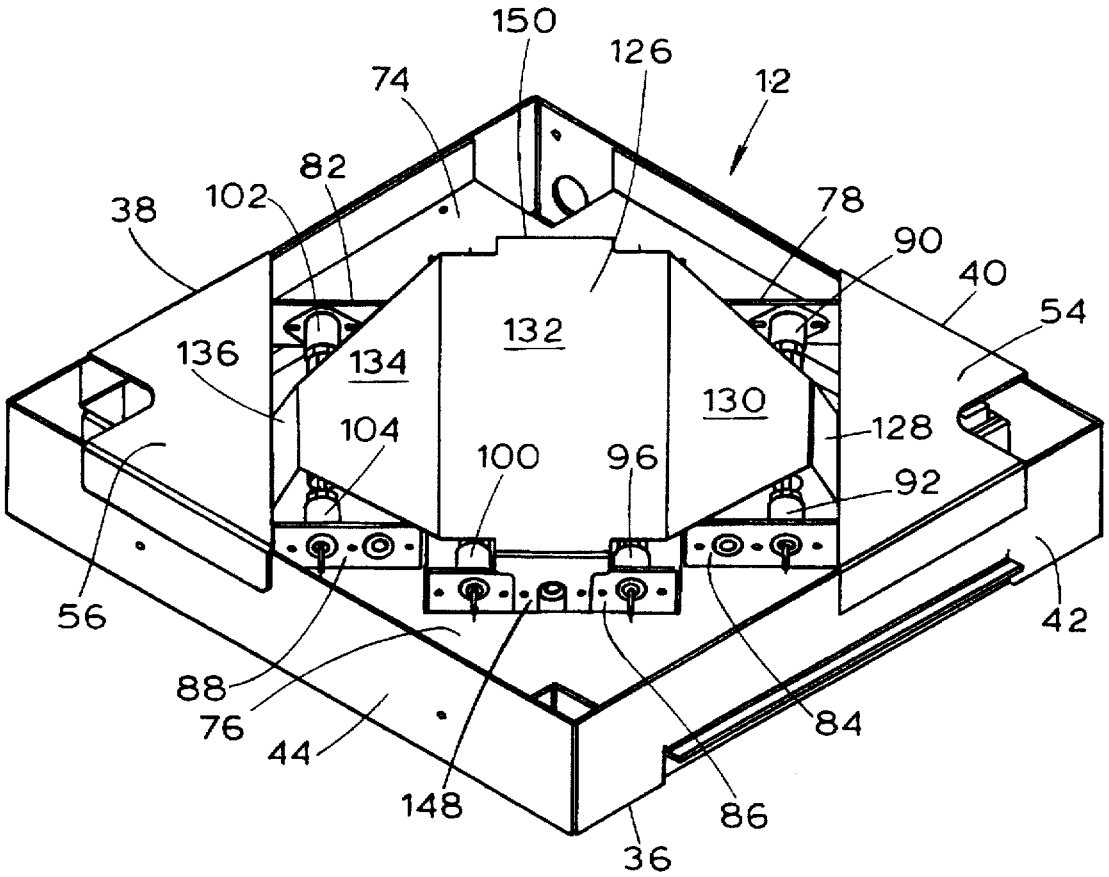
FIG. 2 is an isometric top view of a high energy source module for use in connection with the heating appliance shown in FIG. 1.
Figure 3:
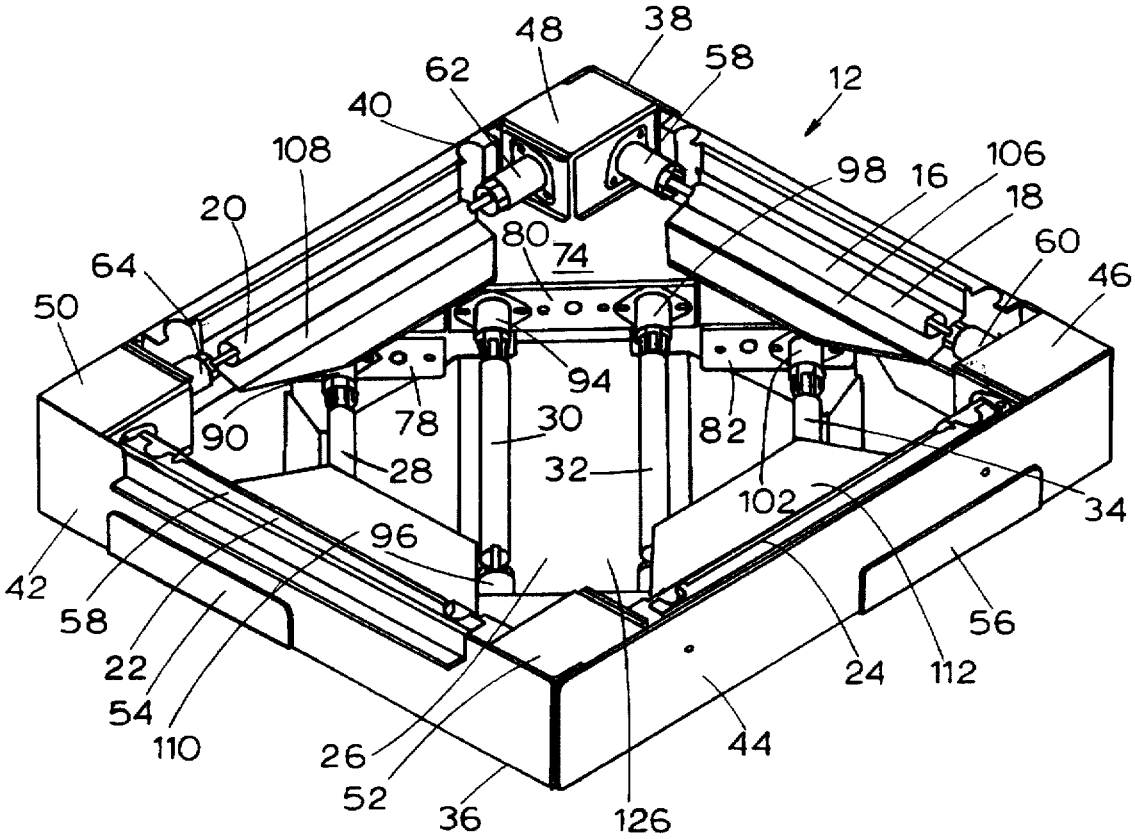
FIG. 3 is a an isometric bottom view of the high energy source module shown in FIG. 2.
Figure 4:
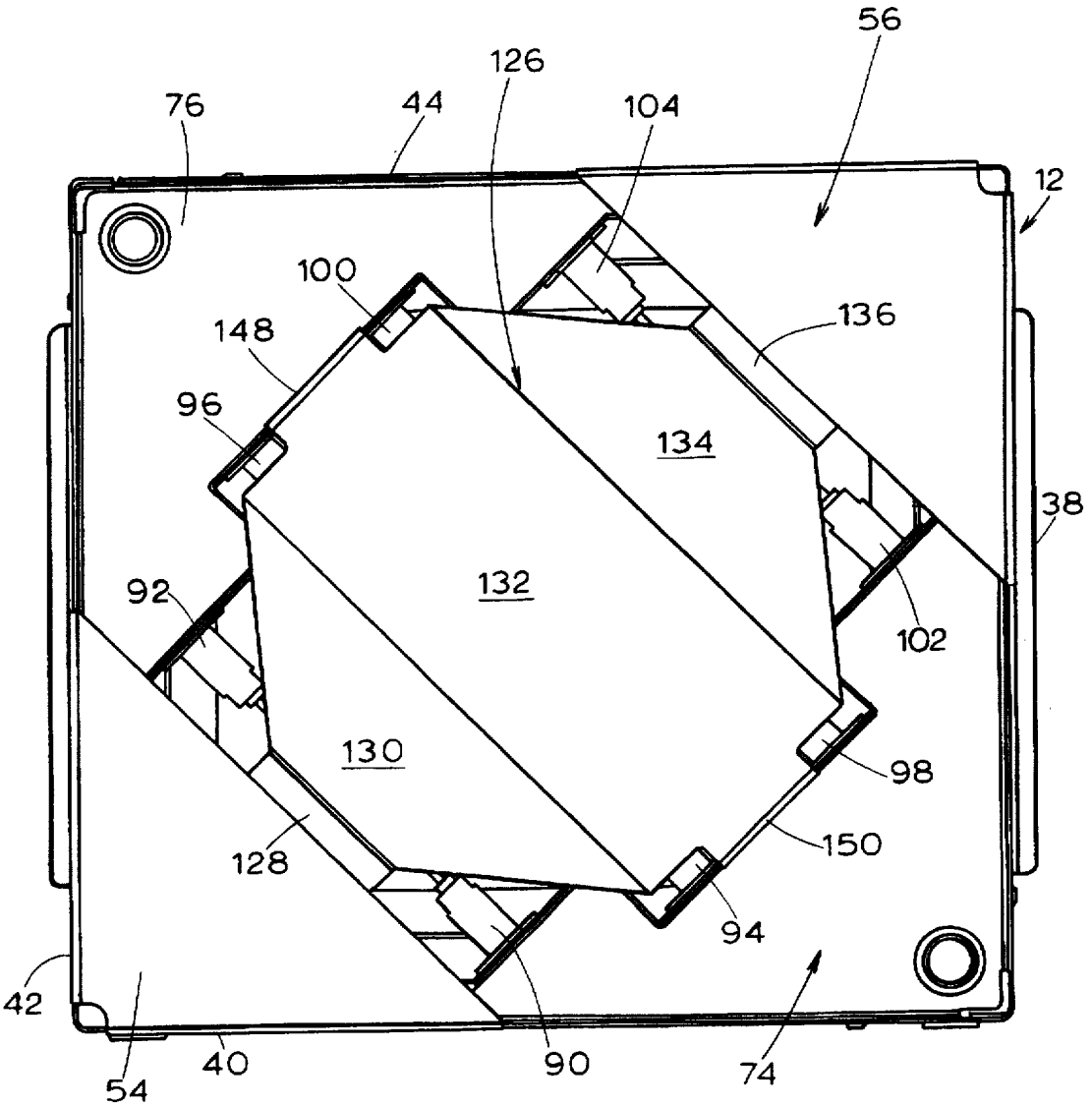
FIG. 4 is a top view of the high energy source module shown in FIGS. 2 and 3.
Figure 5:
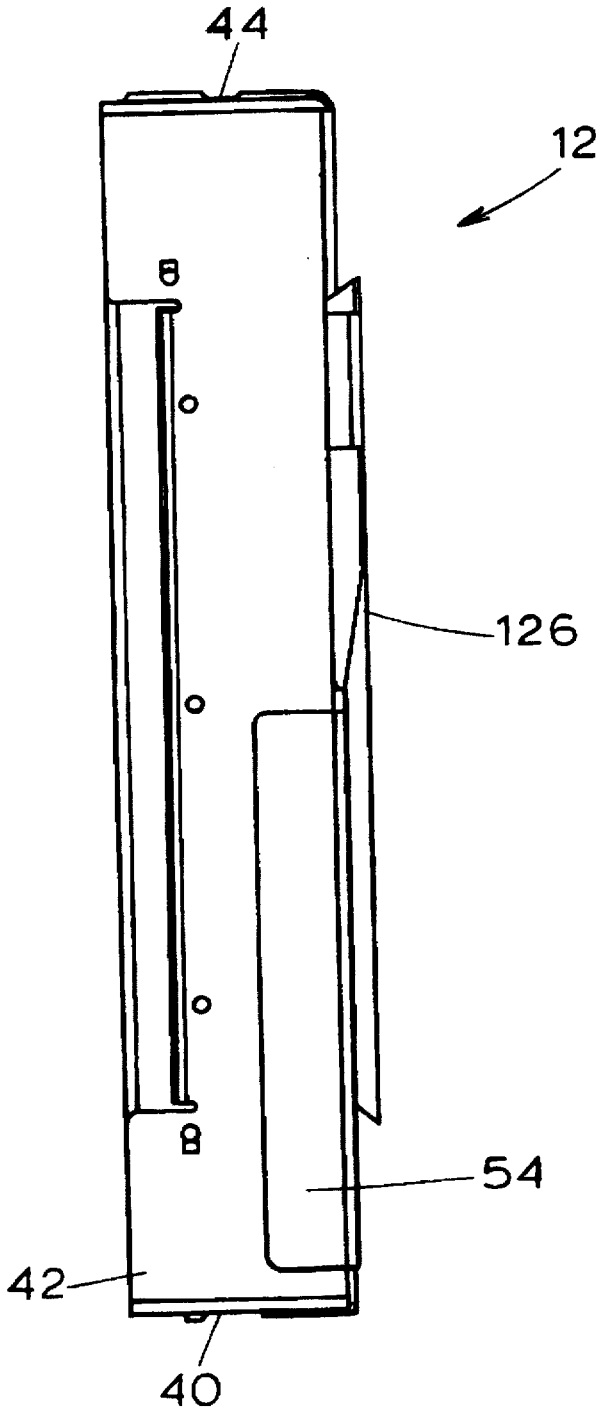
FIG. 5 is a side view of the high energy source module shown in FIGS. 2 and 3.

The high energy source module 12 includes a pair of corner angle brackets 74 and 76 to provide support for the group of diagonally oriented halogen lamps 26. The corner angle bracket 74 is suitably attached to the first side 38 and the second side 40 of the high energy module 12. The corner angle bracket 76 is suitably attached to the third side 42 and the fourth side 44 of the high energy module 12. The corner angle bracket 74 has depending flanges 78, 80, and 82 (FIG. 3). Similarly, the corner angle bracket 76 has depending flanges 84, 86, and 88 (FIG. 2).

Figure 6:
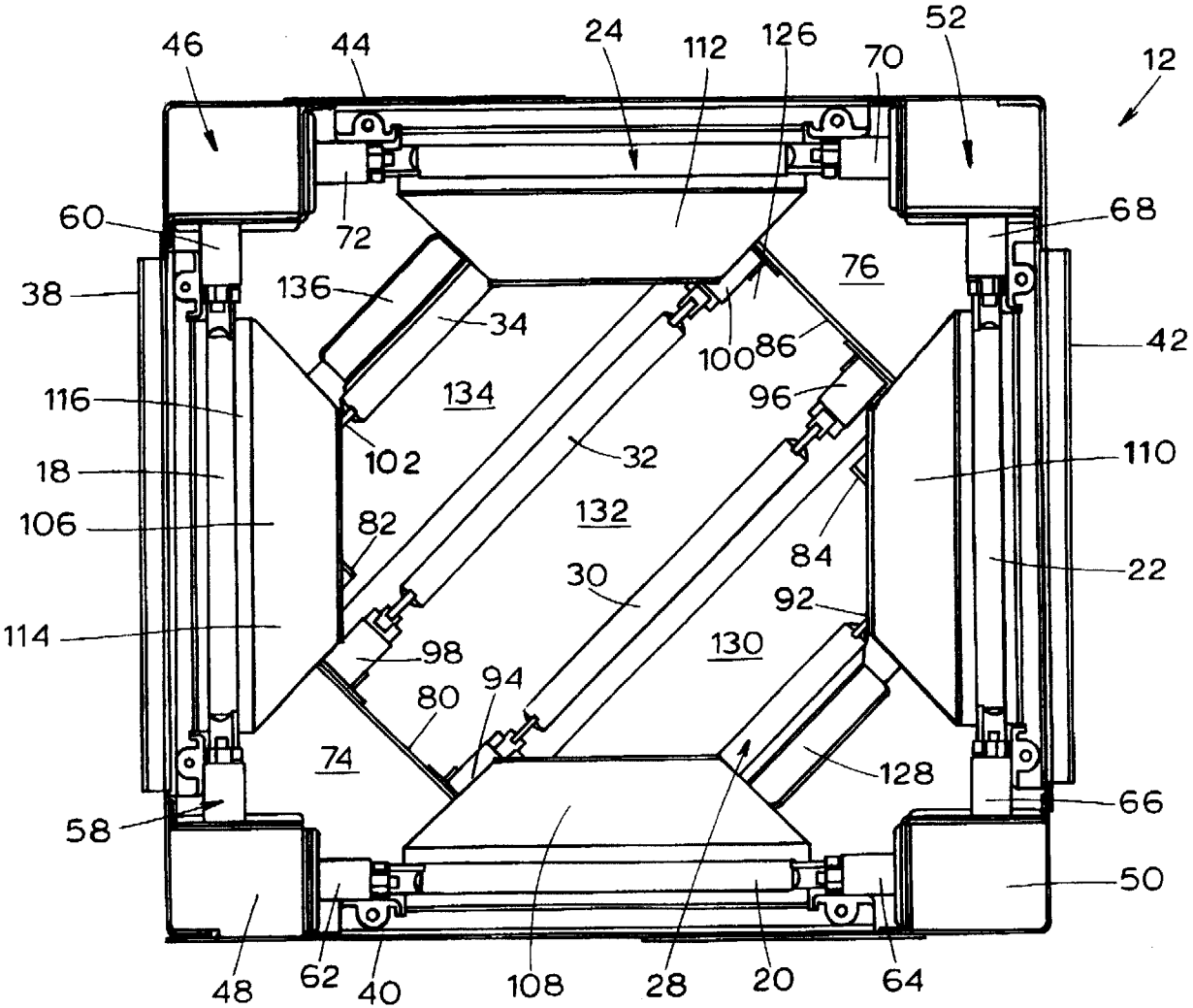
FIG. 6 is a bottom view of the high energy source module shown in FIGS. 2 and 3.

An electrical lamp connector 90 (as seen in FIG. 6) is attached to the flange 78 of the corner angle bracket 74, and an electrical lamp connector 92 is attached to the flange 84 of the corner angle bracket 76. The electrical lamp connectors 90 and 92 receive the fifth halogen lamp 28 and provide an electrical connection therefor.

An electrical lamp connector 94 is attached to the flange 80 of the corner angle bracket 74, and an electrical lamp connector 96 is attached to the flange 86 of the corner angle bracket 76. The electrical lamp connectors 94 and 96 receive the sixth halogen lamp 30 and provide an electrical connection therefor.

An electrical lamp connector 98 is attached to the flange 80 of the corner angle bracket 74, and an electrical lamp connector 100 is attached to the flange 86 of the corner angle bracket 76. The electrical lamp connectors 98 and 100 receive the seventh halogen lamp 32 and provide an electrical connection therefor.

An electrical lamp connector 102 is attached to the flange 82 of the corner angle bracket 74, and an electrical lamp connector 104 is attached to the flange 88 of the corner angle bracket 76. The electrical lamp connectors 102 and 104 receive the eighth halogen lamp 34 and provide an electrical connection therefor.

A generally parabolic reflector is provided for each of the first halogen lamp 18, the second halogen lamp 20, the third halogen lamp 22, and the fourth halogen lamp 24 of the group of side oriented halogen lamps 16. These reflectors are referred to herein as pseudo-parabolic reflectors, although true parabolic reflectors may be used. Accordingly, a first pseudo-parabolic reflector 106 is provided for the first halogen lamp 18, a second pseudo-parabolic reflector 108 is provided for the second halogen lamp 20, a third pseudo-parabolic reflector 110 is provided for the third halogen lamp 22, and a fourth pseudo-parabolic reflector 112 is provided for the fourth halogen lamp 24. The pseudo-parabolic reflectors 106–112 may be substantially identical. Accordingly, an example of only one of these pseudo-parabolic reflectors, i.e., the first pseudo-parabolic reflector 106, is shown detail in FIGS. 7–9.

Figure 9:
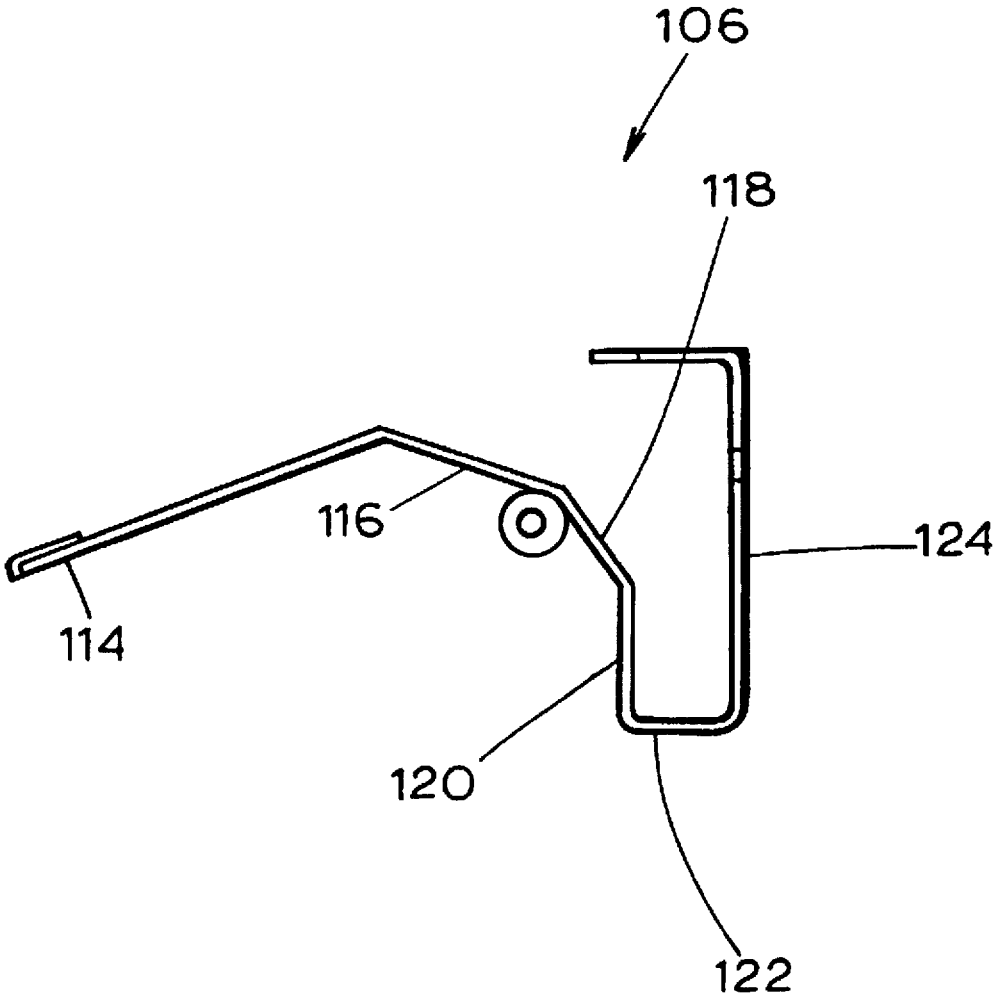
FIG. 9 is a side view of the pseudo-parabolic reflector shown in FIG. 7.

The first pseudo-parabolic reflector 106 has a plurality reflecting surfaces 114–120 as shown in FIG. 9. As can be seen, the reflecting surfaces 114–120 do not form a smoothly varying parabolic reflecting surface because manufacturing a smoothly varying parabolic reflecting surface is difficult and expensive. Therefore, as a trade-off between ease of manufacture and the formation of a truly parabolic reflecting surface, the reflecting surfaces 114–120 of the first pseudo-parabolic reflector 106 are faceted. Accordingly, the facets of the first pseudo-parabolic reflector 106 are arranged to emulate a parabolic reflector so that radiant energy reflected by the first halogen lamp 18 is distributed in the desired manner.

The pseudo-parabolic reflectors 106–112 are arranged to direct the radiant energy from their corresponding first through fourth halogen lamps 18–24 toward the center of a cooking plane (such as an oven rack). This radiant energy from the first, second, third, and fourth heating lamps is thus directed in a direction which is non-perpendicular with respect to the cooking plane and is preferable for certain thick foods such as steaks, roasts, chicken, and the like.

Figure 7:
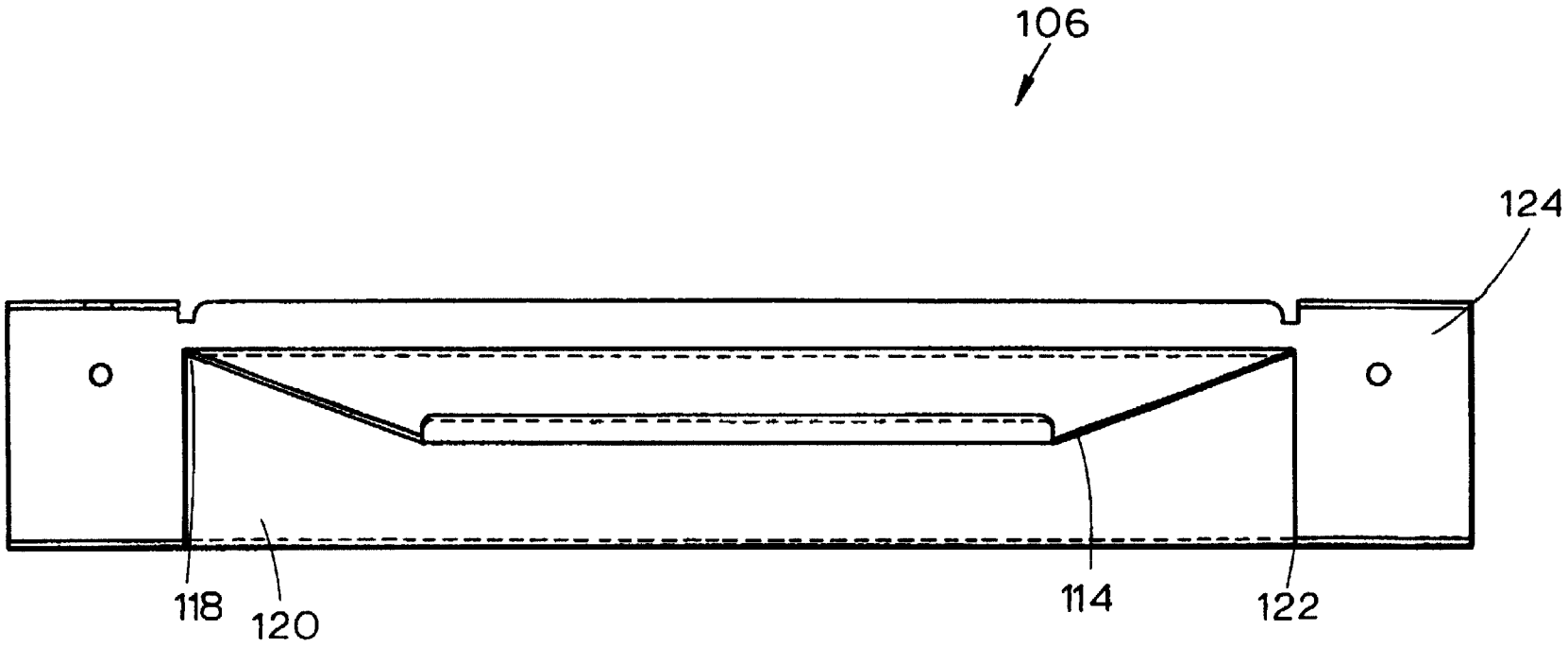
FIG. 7 is a front view of a representative one of four pseudo-parabolic reflectors used in the high energy source module shown in FIGS. 2–6.
Figure 8:
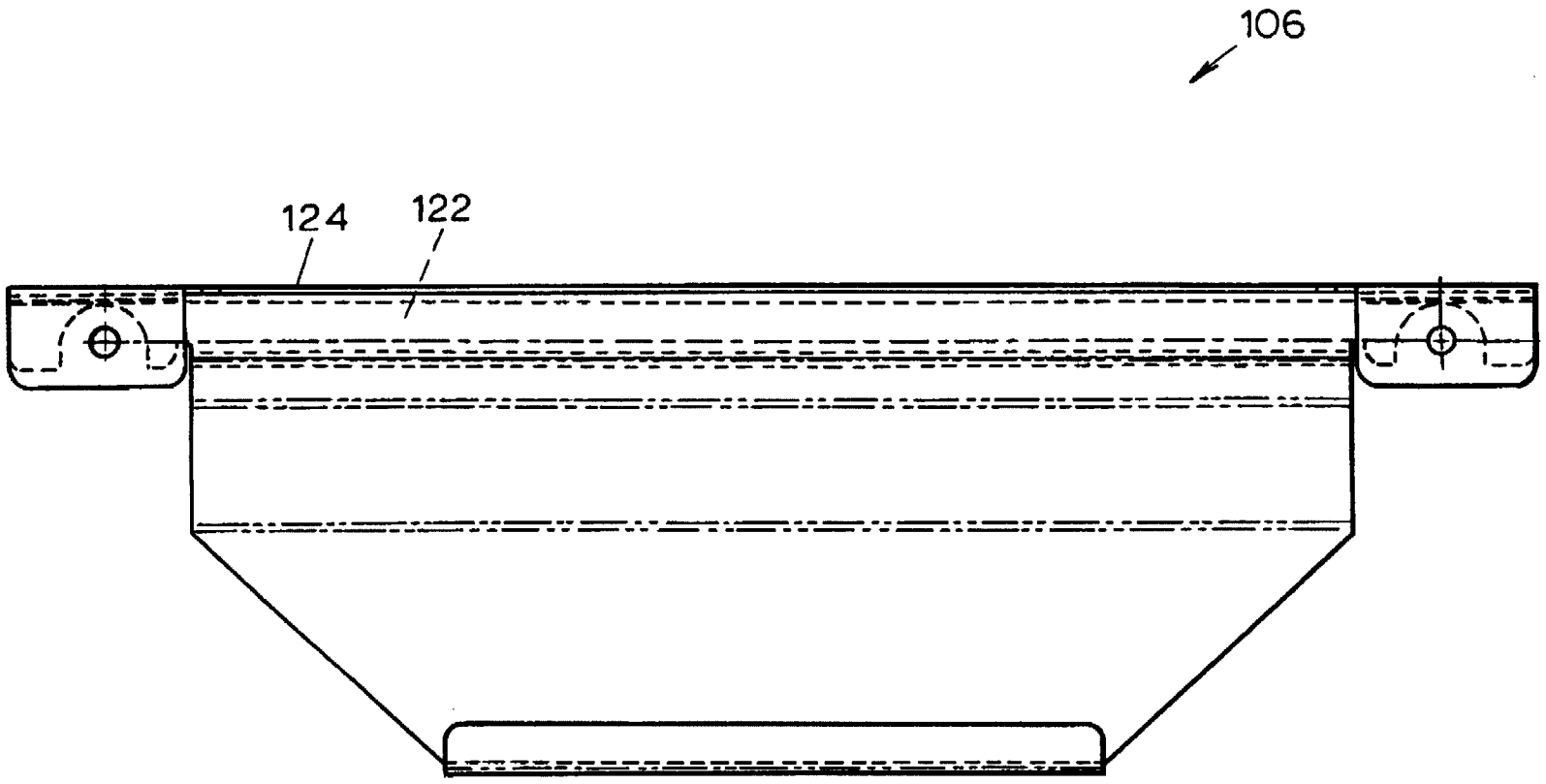
FIG. 8 is a top view of the pseudo-parabolic reflector shown in FIG. 7.

The reflecting surfaces 114, 116, 118, and 120 are formed from a single sheet of reflecting material which is bent according to the arrangement shown in FIGS. 7–9. This sheet from which the reflecting surfaces 114, 116, 118, and 120 are formed may be an anodized aluminum sheet having one bright side which forms the reflecting surfaces 114–120. This sheet also has a horizontal member 122 and a vertical member 124. The vertical member 124 may be suitably attached to the inside surface of the first side 38 of the quadrilateral module frame 36.

Figure 10:
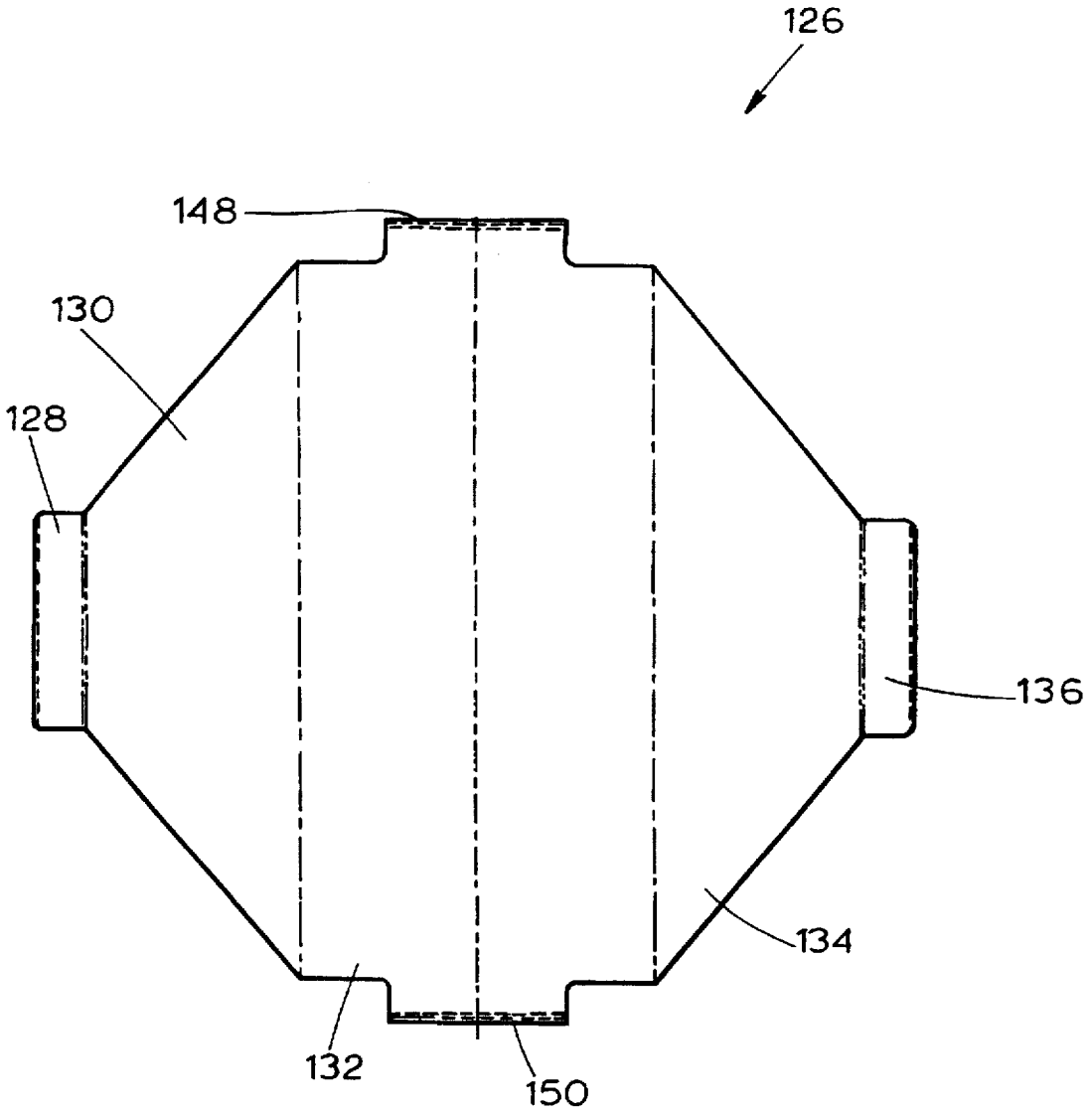
FIG. 10 is a top view of a fifth formed reflector used in the high energy source module shown in FIGS. 2–6.
Figure 11:
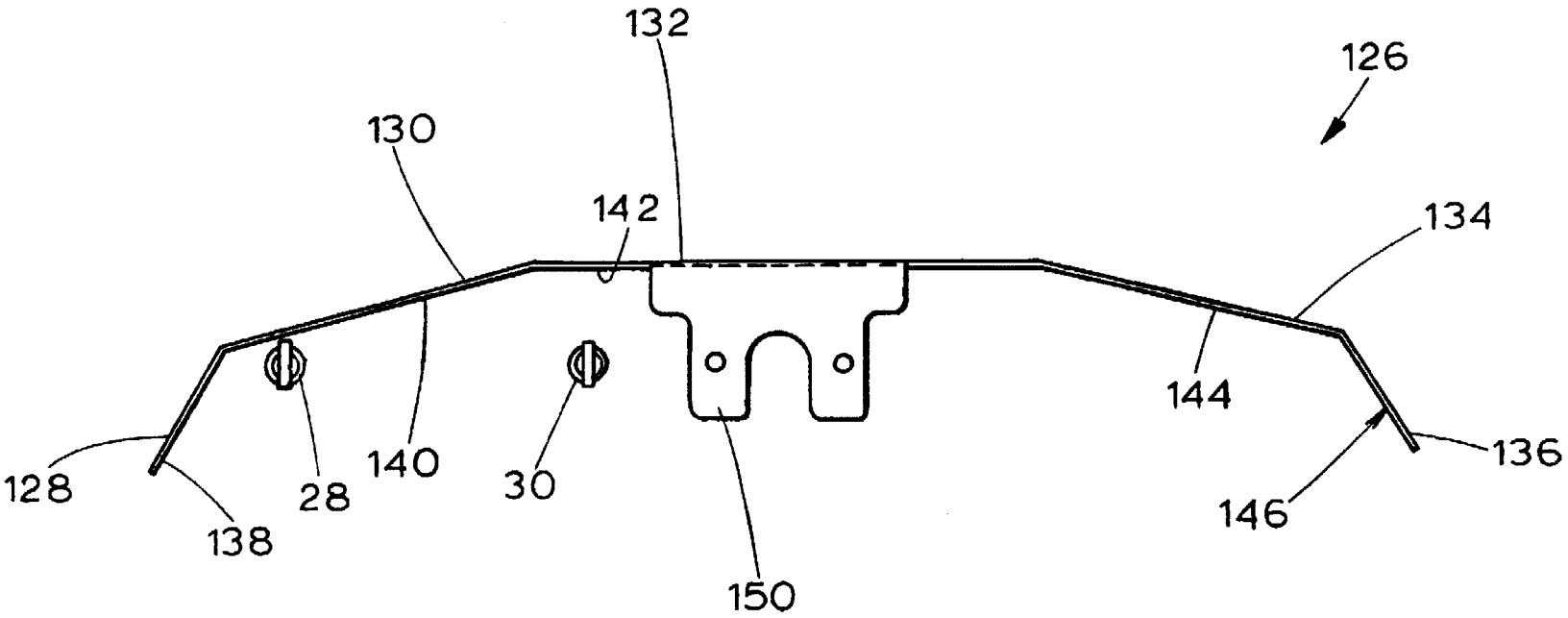
FIG. 11 is a side view of the fifth formed reflector shown in FIG. 10.
Figure 12:
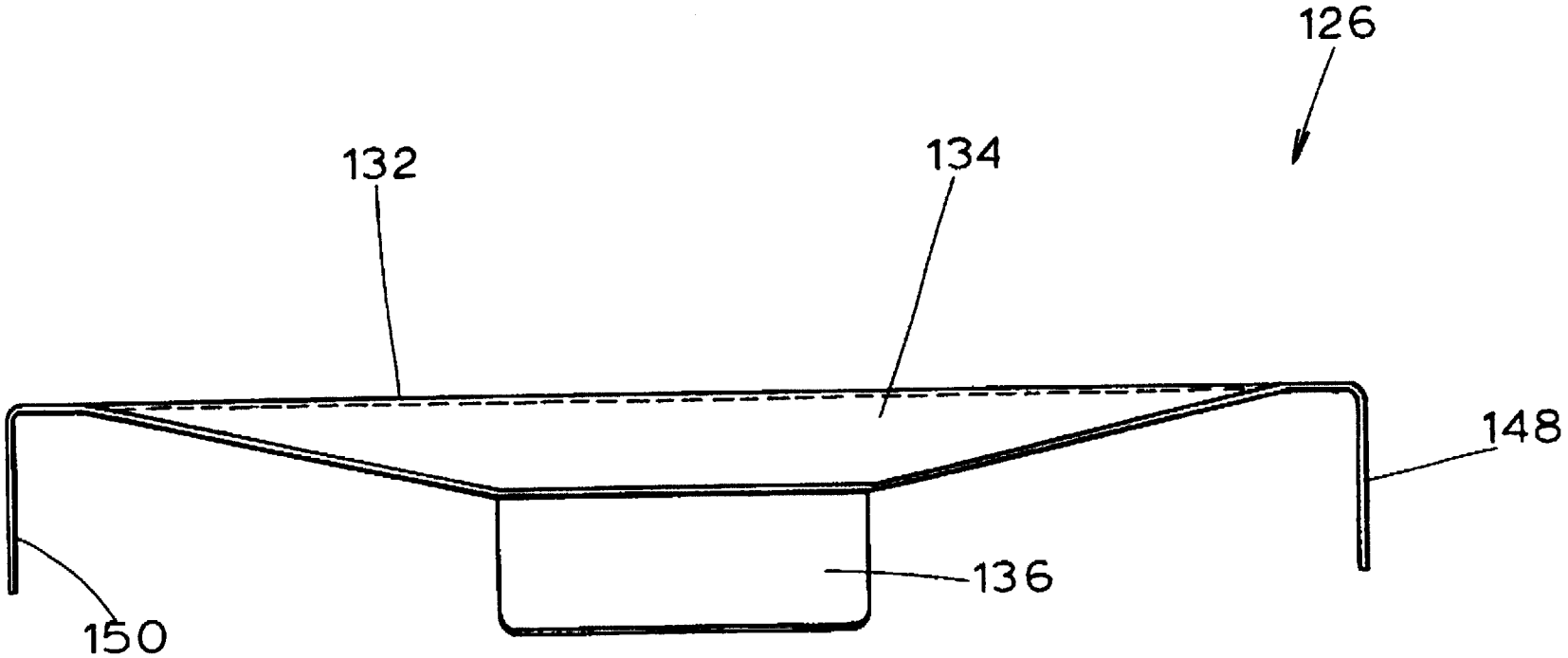
FIG. 12 is a front view of the fifth formed reflector shown in FIG. 10.

A fifth formed reflector 126 is provided for the group of diagonally oriented halogen lamps 26 including the fifth halogen lamp 28, the sixth halogen lamp 30, the seventh halogen lamp 32, and the eighth halogen lamp 34. As shown in FIGS. 10–12, the fifth formed reflector 126 has facets 128, 130, 132, 134 and 136. The facets 128–136 have corresponding reflecting surfaces 138, 140, 142, 144, and 146. The fifth formed reflector 126 also has attachment tabs 148 and 150. As shown in FIG. 2, the attachment tab 148 is suitably attached to the flange 86 of the corner angle bracket 76. Similarly, the attachment tab 150 of the fifth formed reflector 126 is suitably attached to the flange 80 of the corner angle bracket 74. Accordingly, the fifth formed reflector 126 is supported to the quadrilateral module frame 36 by the corner angle brackets 74 and 76.

As in the case of the first pseudo-parabolic reflector 106, the fifth formed reflector 126 is faceted for ease of manufacture and installation. However, with the arrangement shown in FIGS. 10–12, the fifth formed reflector 126 provides a generally parabolic reflecting surface for the group of diagonally oriented halogen lamps 26 which includes the fifth halogen lamp 28, the sixth halogen lamp 30, the seventh halogen lamp 32, and the eighth halogen lamp 34.

The fifth formed reflector 126 directs the radiant energy from the fifth through eighth halogen lamps 28–34 in a straight down and partially hemispherical direction. Accordingly, the radiant energy emitted by the fifth through eighth halogen lamps 28–34 is distributed generally evenly.

With the arrangement of the first through fourth halogen lamps 18–24, together with their respective first through fourth pseudo-parabolic reflectors 106–112, and with the arrangement of the fifth through eighth halogen lamps 28–34, together with their fifth formed reflector 126, radiant energy may be directed toward the center of the cooking plane within the heating enclosure of the heating appliance 10 at a non-perpendicular angle and also may be distributed generally perpendicularly across the cooking plane within the heating enclosure of the heating appliance 10. Also, each halogen lamp of the group of side oriented halogen lamps 16 is mounted parallel to a corresponding side of the quadrilateral module frame 36, while the halogen lamps of the group of diagonally oriented halogen lamps 26 are mounted diagonally across the quadrilateral module frame 36. This mounting arrangement provides a cooking flexibility which is not achieved by heating appliances that have all of their halogen lamps distributed non-diagonally, in parallel, and in a manner which do not provide both generally perpendicular and angled radiant energy.

During heating, the group of side oriented halogen lamps 16 and the group of diagonally oriented halogen lamps 26 may be controlled in unison. Alternatively, the group of side oriented halogen lamps 16 may be controlled independently of the group of diagonally oriented halogen lamps 26 for added cooking flexibility.

Figure 13:
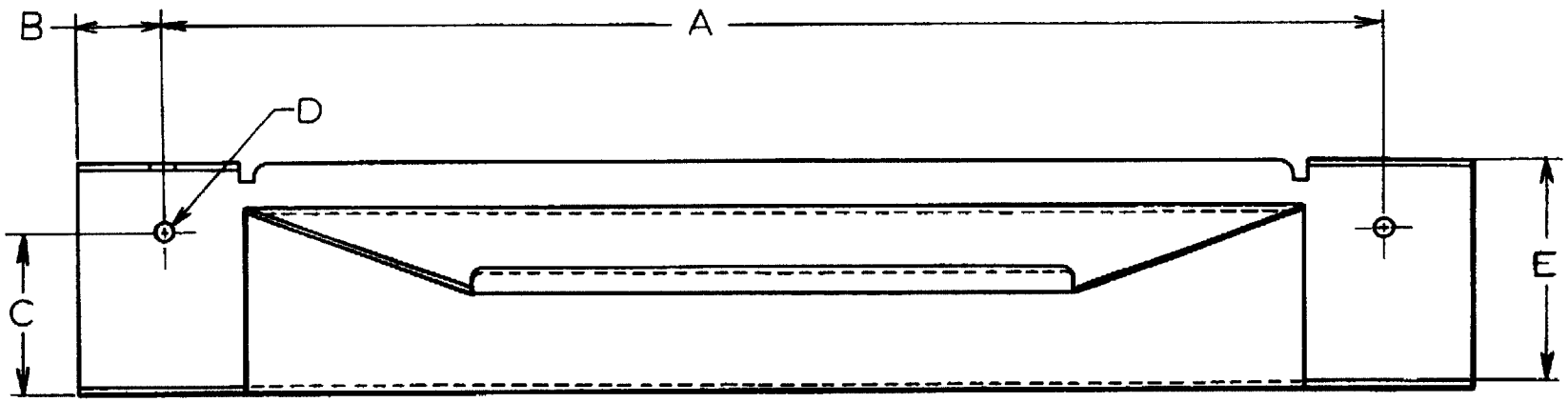
FIGS. 13–18 correspond to FIGS. 7–12 and are useful in providing an exemplary set of dimensions with respect to the present invention.
Figure 14:
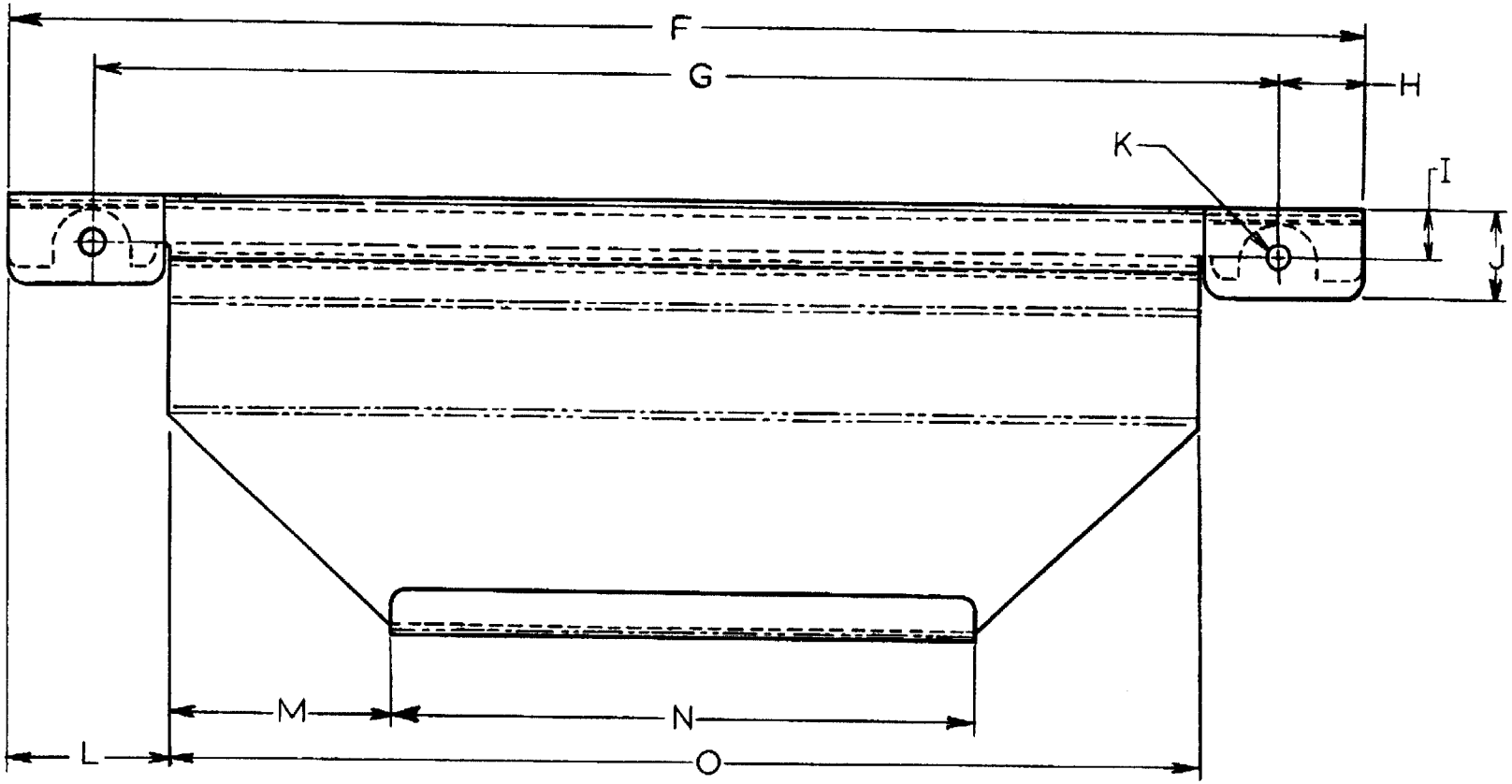
Figure 15:
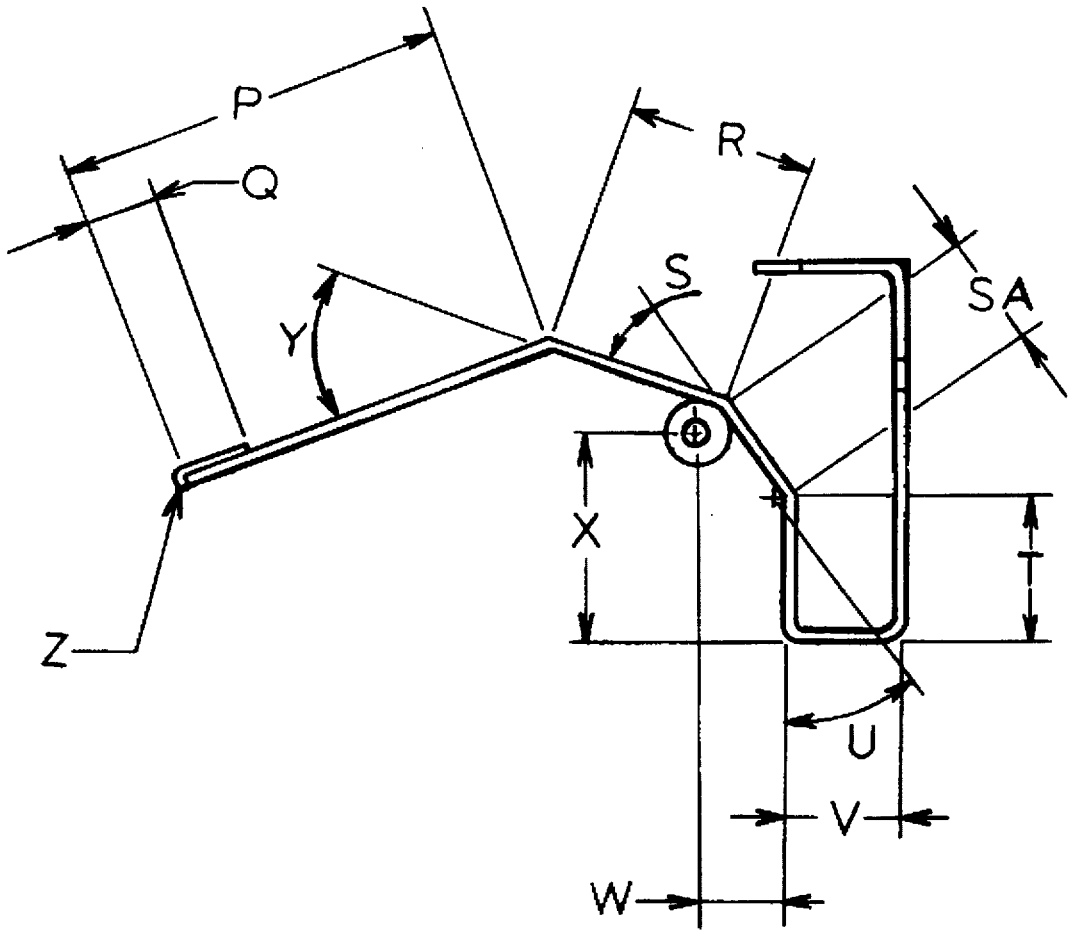

In order to show an exemplary set of dimensions for the pseudo-parabolic reflectors 106–112, the first pseudo-parabolic reflector 106 shown in FIGS. 7–9, which is representative of the pseudo-parabolic reflectors 106–112, is reproduced in FIGS. 13–15. FIG. 15 also illustrates representative dimensions for the position of the first through fourth halogen lamps 18–24 with respect to their corresponding pseudo-parabolic reflectors 106–112. However, it should be noted that any other desired position of the first through fourth halogen lamps 18–24 with respect to their corresponding pseudo-parabolic reflectors 106–112 is possible. The exemplary set of dimensions are as follows:

| | |
|---|---|
| A | 7.500 |
| B | 0.535 |
| C | 1.000 |
| D | 0.110 ϕ 2PLCS |
| E | 1.410 |
| F | 8.570 |
| G | 7.500 |
| H | 0.535 |
| I | 0.312 |
| J | 0.562 |
| K | 0.157 2HOLES |
| L | 1.035 |
| M | 1.428 |
| N | 3.644 |
| O | 6.500 |
| P | 1.450 |
| Q | 0.260 |
| R | 0.710 |
| S | 36.0° |
| SA | 0.415 |
| T | 0.540 |
| U | 34.5° |
| V | 0.425 |
| W | 0.427 |
| X | 0.697 |
| Y | 40.0° |
| Z | OR 0.040 |

These above dimensions may be in any desired units and, therefore, are intended to be only relational.

Figure 16:
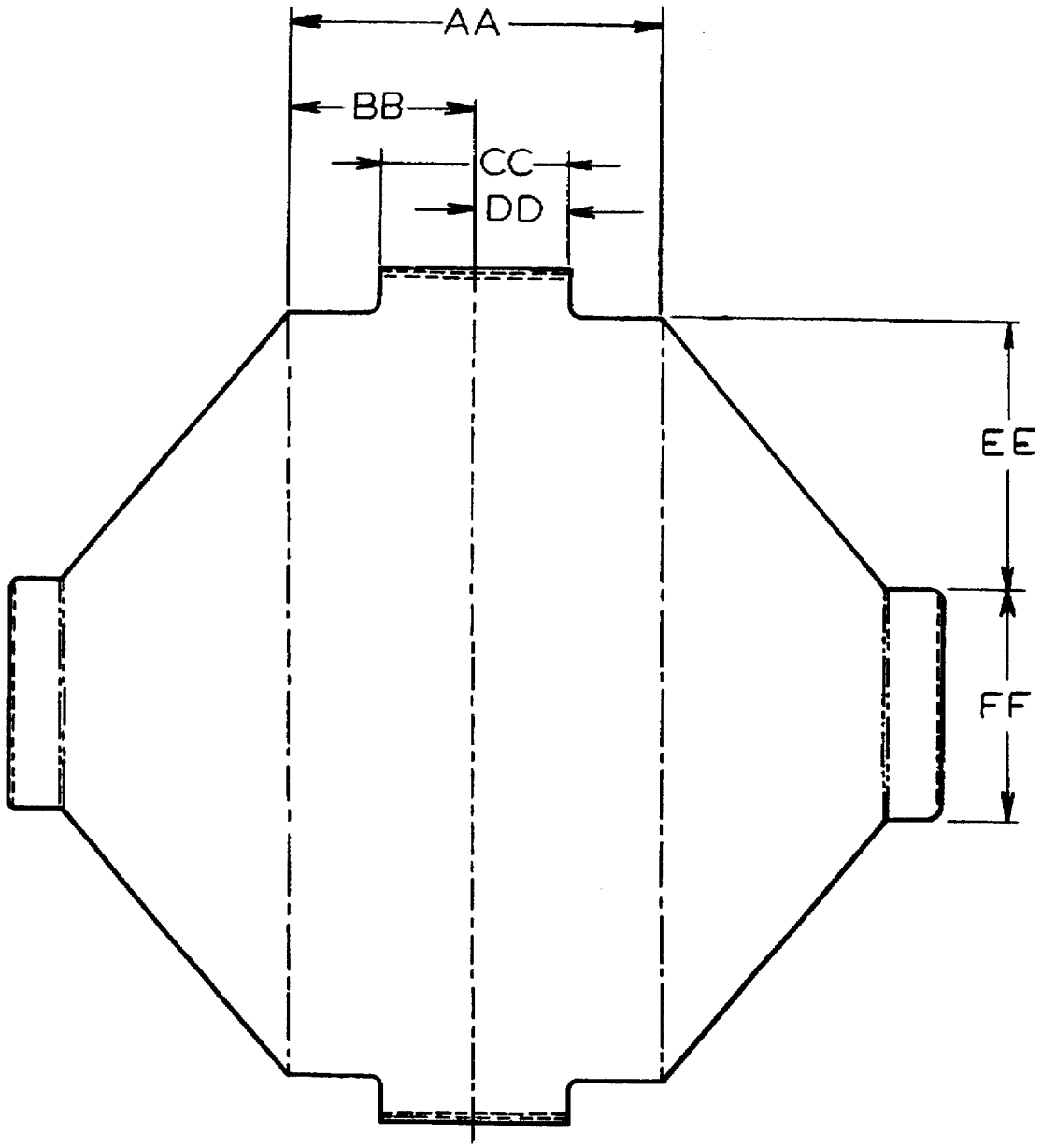
Figure 17:
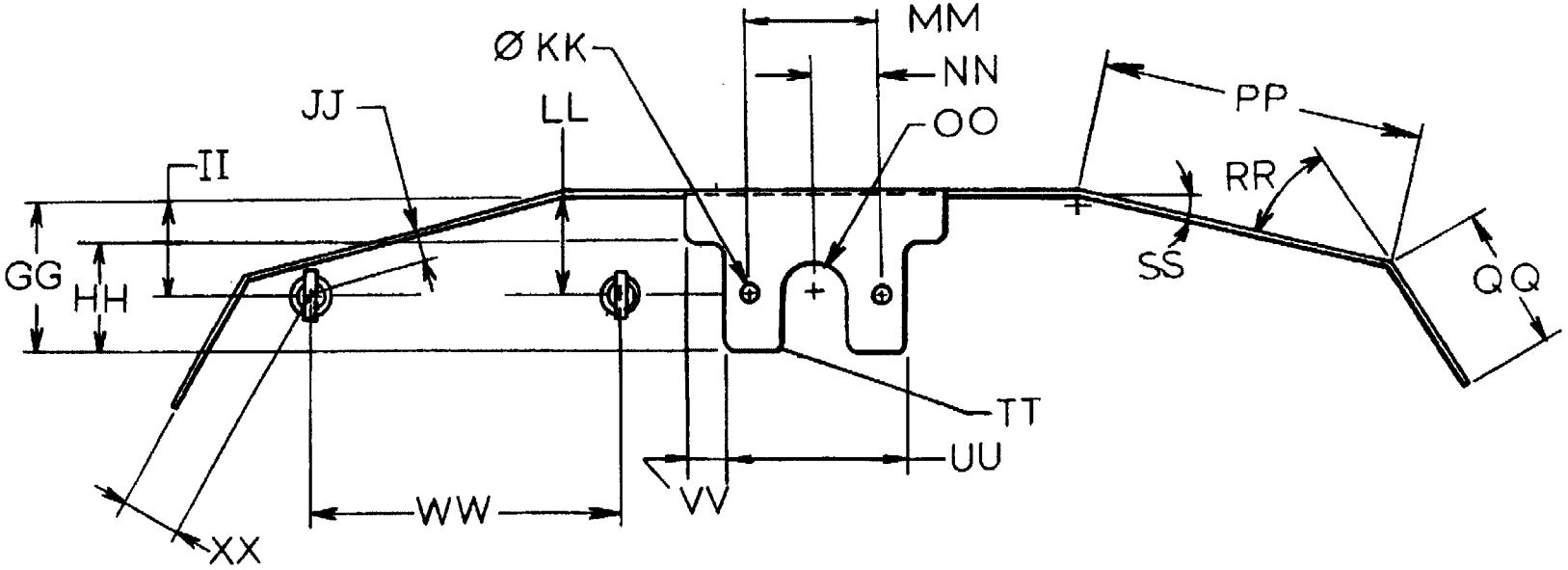
Figure 18:
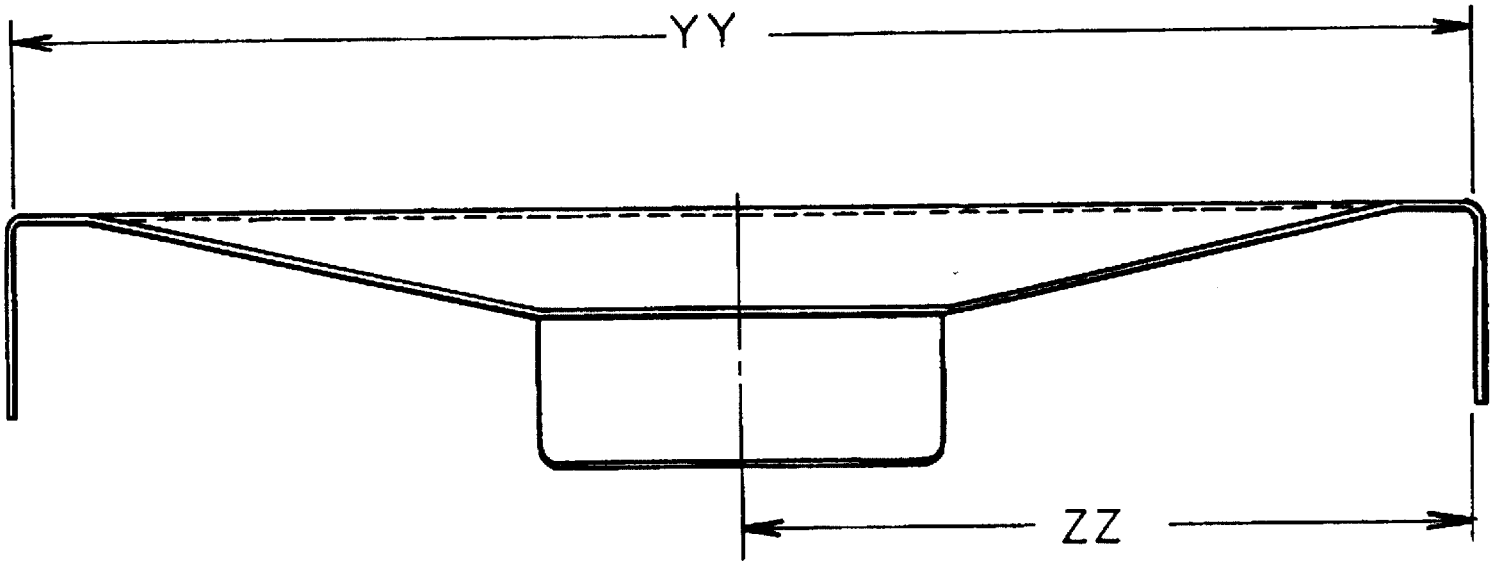

Also, in order to show an exemplary set of dimensions for the fifth formed reflector 126, the fifth formed reflector shown in FIGS. 10–12 is reproduced in FIGS. 16–18. FIG. 11 illustrates representative dimensions for the position of the fifth halogen lamp 28 and the sixth halogen lamp 30 with respect to the fifth formed reflector 126. The seventh halogen lamp 32 and the eighth halogen lamp 34 are similarly positioned. However, it should be noted that any other desired positions for these halogen lamps are possible.

| | |
|---|---|
| AA | 4.040 |
| BB | 2.020 |
| CC | 2.050 |
| DD | 1.025 |
| EE | 3.050 |
| FF | 2.660 |

-continued

| | |
|---|---|
| GG | 1.250 |
| HH | 0.875 |
| II | 0.800 |
| JJ | 0.271 |
| KK | ϕ 0.125 |
| LL | 0.800 |
| MM | 1.024 |
| NN | 0.512 |
| OO | R 0.250 |
| PP | 2.562 |
| QQ | 1.125 |
| RR | 45.0° |
| SS | 14.0° |
| TT | R 0.093TYP |
| UU | 1.400 |
| VV | 0.325 |
| WW | 2.712 |
| XX | 0.436 |
| YY | 9.680 |
| ZZ | 4.840 |

These above dimensions may be in any desired units and, therefore, are intended to be only relational.

Certain modifications of the present invention have been discussed above. Other modifications will occur to those practicing in the art of the present invention. For example, although the high energy source module 12 is described as having a quadrilateral module frame 36, the module frame may have any desired geometric shape as long as the halogen lamps supported thereby are not all parallel to each other.

Also, more or fewer halogen lamps in the group of diagonally oriented halogen lamps 26 may be provided. Moreover, fewer than the four halogen lamps of the group of side oriented halogen lamps 16 may be provided. For example, two halogen lamps along opposing sides of the high energy source module 12 may be provided.

Furthermore, the dimensions for the parabolic reflectors shown in FIGS. 13–18 are illustrative only. These dimensions will change depending upon the configuration of the oven in which the high energy source module 12 is used and the types of food to be cooked.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. A heating appliance comprising a generally hexahedral enclosure and a plurality of high energy lamps arranged to emit radiant energy to an object to be heated, wherein at least one of the high energy lamps is mounted substantially parallel to a side of the generally hexahedral enclosure, and wherein at least another of the high energy lamps is mounted substantially diagonally with respect to the generally hexahedral enclosure.

2. The heating appliance of claim 1 further comprising a reflector arranged to reflect radiant energy from the plurality of high energy lamps so that the reflected radiant energy is distributed generally perpendicularly across a heating plane within the heating appliance.

3. The heating appliance of claim 1, further comprising a reflector arranged to reflect radiant energy from the plurality of high energy lamps so that the reflected radiant energy is directed toward a center of a heating plane.

4. The heating appliance of claim 3 wherein the reflector is a first reflector, and further comprising a second reflector arranged to reflect radiant energy from the plurality of high energy lamps so that the radiant energy reflected by the second reflector is distributed generally perpendicularly across the heating plane.

5. The heating appliance of claim 1, wherein the plurality of high energy lamps includes a plurality of high energy lamps mounted substantially parallel to one another and diagonally with resect to the generally hexahedral enclosure.

6. The heating appliance of claim 1, wherein the plurality of high energy lamps includes first and second pluralities of high energy lamps, wherein the generally hexahedral enclosure includes first, second, third, and fourth sides, wherein the first plurality of high energy lamps are mounted substantially parallel to at least some of the first, second, third, and fourth sides, and wherein the second plurality of high energy lamps are mounted substantially diagonally with respect to the first, second, third, and fourth sides.

7. The heating appliance of claim 6 further comprising a reflector arranged to reflect radiant energy from one of the second plurality of high energy lamps so than the reflected radiant energy is distributed generally perpendicularly across a heating plane within the heating appliance.

8. The heating appliance of claim 6 further comprising a reflector arranged to reflect radiant energy from one of the first plurality of high energy lamps so that the radiant energy reflected by the second reflector is directed toward a center of a heating plane.

9. The heating appliance of claim 8 wherein the reflector is a first reflector, and further comprising a second reflector arranged to reflect radiant energy from the second plurality of high energy lamps so that the radiant energy reflected by the second reflector is distributed generally perpendicularly across the heating plane within the heating appliance.

10. The heating appliance of claim 6 wherein the first plurality of high energy lamps comprises:

a first high energy lamp mounted substantially parallel to the first side;

a second high energy lamp mounted substantially parallel to the second side;

a third high energy lamp mounted substantially parallel to the third side; and, a fourth high energy lamp mounted substantially parallel to the fourth side; and, wherein the second plurality of high energy lamps comprises fifth and sixth high energy lamps mounted substantially diagonally to the first, second, third, and fourth sides.

11. The heating appliance of claim 10 further comprising:

a first reflector for the first, second, third, and fourth high energy lamps, wherein the first reflector is arranged to reflect radiant energy from the first, second, third, and fourth high energy lamps so that the radiant energy reflected by the first reflector is directed toward a center of a heating plane; and a second reflector for the fifth and sixth high energy lamps, wherein the second reflector is arranged to reflect radiant energy from the fifth and sixth high energy lamps so that the radiant energy reflected by the second reflector is distributed generally perpendicularly across the heating plane within the heating appliance.

12. The heating appliance of claim 11 wherein the first reflector is generally parabolic in shape, and wherein the second reflector is a formed reflector.

13. The heating appliance of claim 11 wherein the first reflector comprises separate reflectors for the first, second, third, and fourth high energy lamps.

14. An oven comprising:

an oven housing having sides;

first radiant energy emitting means for emitting radiant energy, wherein the first radiant energy emitting means is mounted to the oven housing, and wherein the first radiant energy emitting means is substantially parallel to one of the sides of the oven housing; and second radiant energy emitting means for emitting radiant energy, wherein the second radiant energy emitting means is mounted to the oven housing, and wherein the second radiant energy emitting means is substantially diagonal with respect the sides of the oven housing.

15. The oven of claim 14 further comprising reflecting means for reflecting radiant energy from one of the first and second radiant energy emitting means so that the reflected radiant energy is distributed generally perpendicularly across a heating plane.

16. The oven of claim 14 further comprising reflecting means for reflecting radiant energy from one of the first and second radiant energy emitting means so that the reflected radiant energy is directed toward a center of a heating plane.

17. The oven of claim 16 wherein the reflecting means is a first reflecting means, and further comprising second reflecting means for reflecting radiant energy from the other of the first and second radiant energy emitting means so that the radiant energy reflected by the second reflecting means is distributed generally perpendicularly across the heating plane.

18. The oven of claim 17 wherein the oven housing comprises a module frame.

19. The oven of claim 17 wherein the first reflecting means is a formed reflector, and wherein the second reflecting means is generally parabolic in shape.

20. The oven of claim 14 wherein the sides comprises first, second, third, and fourth sides, wherein the first radiant energy emitting means comprises a first high energy lamp mounted substantially parallel to the first side, a second high energy lamp mounted substantially parallel to the second side, a third high energy lamp mounted substantially parallel to the third side, and a fourth high energy lamp mounted substantially parallel to the fourth side, and wherein the second radiant energy emitting means comprises fifth and sixth high energy lamps mounted substantially diagonally to the first, second, third, and fourth sides.

21. The oven of claim 20 further comprising:

a first reflector for the first, second, third, and fourth high energy lamps, wherein the first reflector is arranged to reflect radiant energy from the first, second, third, and fourth high energy lamps so that the radiant energy reflected by the first reflector is directed toward a center of a heating plane; and a second reflector for the fifth and sixth high energy lamps, wherein the second reflector is arranged to reflect radiant energy from the fifth and sixth high energy lamps so that the radiant energy reflected by the second reflector is distributed generally perpendicularly across the heating plane.

22. The oven of claim 21 wherein the first reflector is generally parabolic in shape, and wherein the second reflector is a formed reflector.

23. The oven of claim 21 wherein the first reflector comprises separate reflectors for the first, second, third, and fourth high energy lamps.

24. The oven of claim 21 wherein the oven housing comprises a module frame.

25. The oven of claim 14 wherein the oven housing comprises a module frame.

26. A heating arrangement for an oven comprising:

a source support having first, second, third, and fourth sides;

a first heating lamp mounted substantially along the first side of the source support;

a second heating lamp mounted substantially along the second side of the source support;

a third heating lamp mounted substantially along the third side of the source support;

a fourth heating lamp mounted substantially along the fourth side of the source support; and fifth, sixth, and seventh heating lamps mounted substantially diagonally with respect to the first, second, third, and fourth sides of the source support.

27. The heating arrangement of claim 26 further comprising reflectors arranged to reflect radiant energy from the first, second, third, fourth, fifth, sixth, and seventh heating lamps.

28. The heating arrangement of claim 27 wherein the reflector comprises:

a first reflector for reflecting radiant energy from the first heating lamp;

a second reflector for reflecting radiant energy from the second heating lamp;

a third reflector for reflecting radiant energy from the third heating lamp;

a fourth reflector for reflecting radiant energy from the fourth heating lamp; and a fifth reflector for reflecting radiant energy from the fifth, sixth, and seventh heating lamps.

29. The heating arrangement of claim 28 wherein the first, second, third, and fourth reflectors are generally parabolic reflectors, and wherein the fifth reflector is a formed reflector.

30. A source arranged to emit radiant energy to an object to be heated within a cooking appliance having a cooking plane, the source comprising:

first and second radiant energy emitting means for emitting radiant energy, wherein the first and second radiant energy emitting means are generally above the cooking plane;

first reflecting means for reflecting radiant energy from the first radiant energy emitting means toward a center of the cooking plane; and second reflecting means for reflecting radiant energy from the second radiant energy emitting means generally perpendicularly over the cooking plane.

* * * * *